US006106225A

United States Patent [19]

Enns

[11] Patent Number: 6,106,225

[45] Date of Patent: Aug. 22, 2000

[54] SUBMERSIBLE FOUNTAIN PUMP DESIGN

[75] Inventor: Douglas Brent Enns, Plano, Tex.

[73] Assignee: Beckett Corporation, Irving, Tex.

[21] Appl. No.: 09/023,608

[22] Filed: Feb. 13, 1998

Related U.S. Application Data

[60] Provisional application No. 60/041,222, Feb. 13, 1997, abandoned.

[51] Int. Cl.[7] ..... F01D 25/24

[52] U.S. Cl. ..... 415/127; 415/126; 415/128; 415/121.2

[58] Field of Search ..... 415/126, 127, 415/128, 121.2; 417/423.3, 360; 405/36, 52

[56] References Cited

U.S. PATENT DOCUMENTS

| | | | |
|---|---|---|---|
| D. 328,305 | 7/1992 | Wang | D15/9 |
| D. 340,458 | 10/1993 | Wang | D15/7 |
| D. 340,726 | 10/1993 | Wang | D15/7 |
| D. 352,295 | 11/1994 | Morgan | D15/9 |
| 1,118,739 | 11/1914 | Carter | 415/127 |
| 3,234,885 | 2/1966 | Englesson | 415/126 |
| 4,930,982 | 6/1990 | Channell | 415/121.2 |
| 5,131,821 | 7/1992 | Marioni et al. | 417/423.3 |
| 5,205,725 | 4/1993 | Pattison | 417/423.3 |
| 5,714,814 | 2/1998 | Marioni | 310/87 |

*Primary Examiner*—Edward K. Look
*Assistant Examiner*—Ninh Nguyen
*Attorney, Agent, or Firm*—Sidley & Austin

[57] ABSTRACT

A pump (10, 30) is disclosed which has an intake (16). A rotatable volute (22) can be positioned at least two different positions on the housing (12) of the pump so that the inlet can be at the top of the pump or at the bottom of the pump for use in dirty water applications or shallow water applications, respectively.

11 Claims, 3 Drawing Sheets

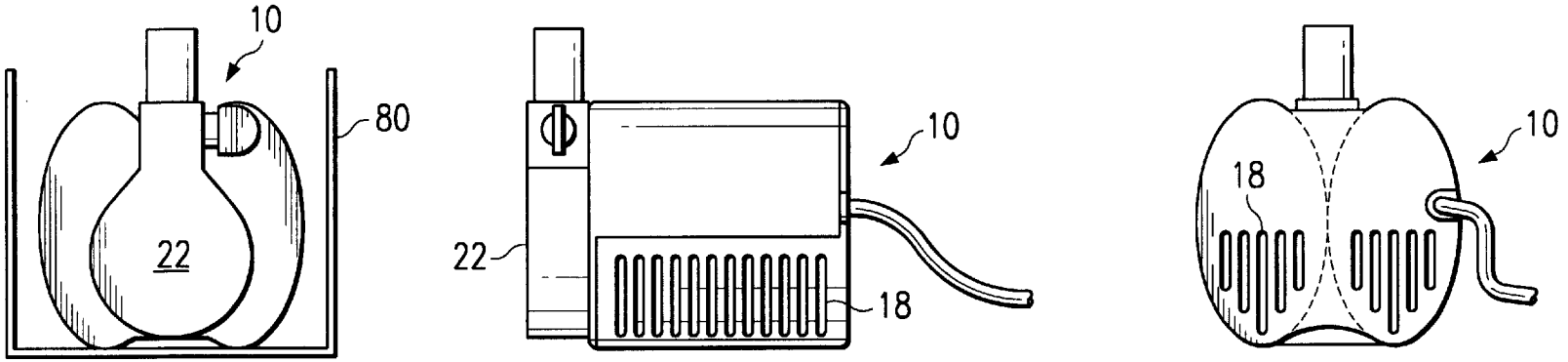
FIG. 1c
FIG. 1b
FIG. 1a
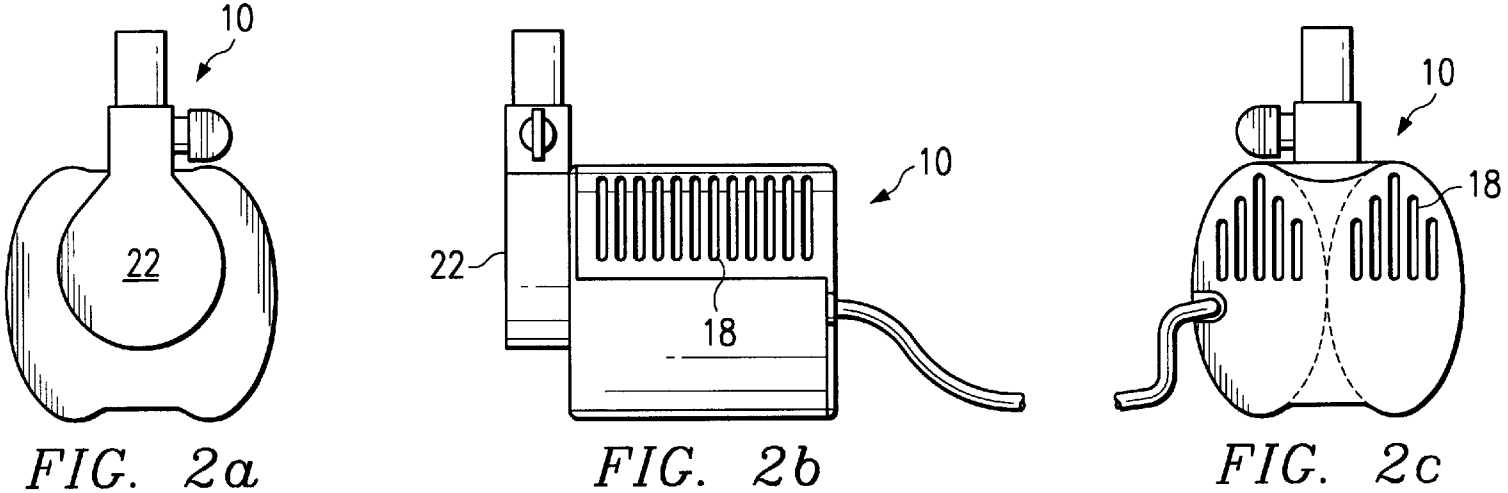
FIG. 2c
FIG. 2b
FIG. 2a

SUBMERSIBLE FOUNTAIN PUMP DESIGN

This application claims the benefit of U.S. Provisional Application No. 60/041,222, filed Feb. 13, 1997, now abandoned.

BACKGROUND OF THE INVENTION

A pump will draw a fluid from an inlet for transfer to the desired final location. The inlet is commonly oriented within a volume of fluid to be pumped near the bottom of the volume so that the pump can pick up as much fluid as is possible. Where there is debris or other contaminants, however, if the inlet is too low within the volume, the inlet risks being clogged, causing the pump to lose efficiency or even stop pumping.

SUMMARY OF THE INVENTION

In accordance with one aspect of the present invention, a submersible fountain pump is provided which includes an intake port and a volute. The volute can be rotated 180 degrees, allowing the pump to be positioned with the intake on the bottom for shallow water applications or on the top for dirty water applications.

BRIEF DESCRIPTION OF THE DRAWINGS

A more complete understanding of the invention and its advantages will be apparent from the following detailed description when taken in conjunction with the accompanying drawings in which:

FIGS. 1*a*, 1*b* and 1*c* illustrate a front, side and rear view of a pump formed in accordance with the teachings of the present invention with the intake on the bottom for low pickup;

FIGS. 2*a*, 2*b* and 2*c* show front, side and back views of the pump with the intake on the top for dirty water;

DETAILED DESCRIPTION OF THE INVENTION

The small (30–1000 (gallons per hour)) submersible fountain pumps that currently exist in the market fall into one of two basic categories regarding pump intake position. They either have bottom intake ports or they have front (or side) intake ports. When submersible fountain ports are used in tabletop fountains, statuaries, or other clean shallow water applications, it is advantageous for them to have a bottom intake port. A pump with a bottom intake port can operate in only one-half inch or less of water, while a pump with a front intake would begin to cavitate and quit functioning at a much higher minimum water level. In contrast, when small submersible fountain pumps are used in garden ponds, fish ponds, or other dirty water applications, it is desirable for the pump's intake to be raised off of the pond bottom. This prevents the pump from becoming plugged by the silt or other debris that typically exists on the pond bottom. Pumps with front intakes can generally operate in dirty water environments much longer than pumps with bottom intakes before becoming plugged with debris.

For the reasons mentioned above, pumps that currently exist in the market are well suited for either shallow, clean water applications (i.e., small fountains or statuaries) or dirty water applications (i.e. ponds), but not both.

Figure 4:
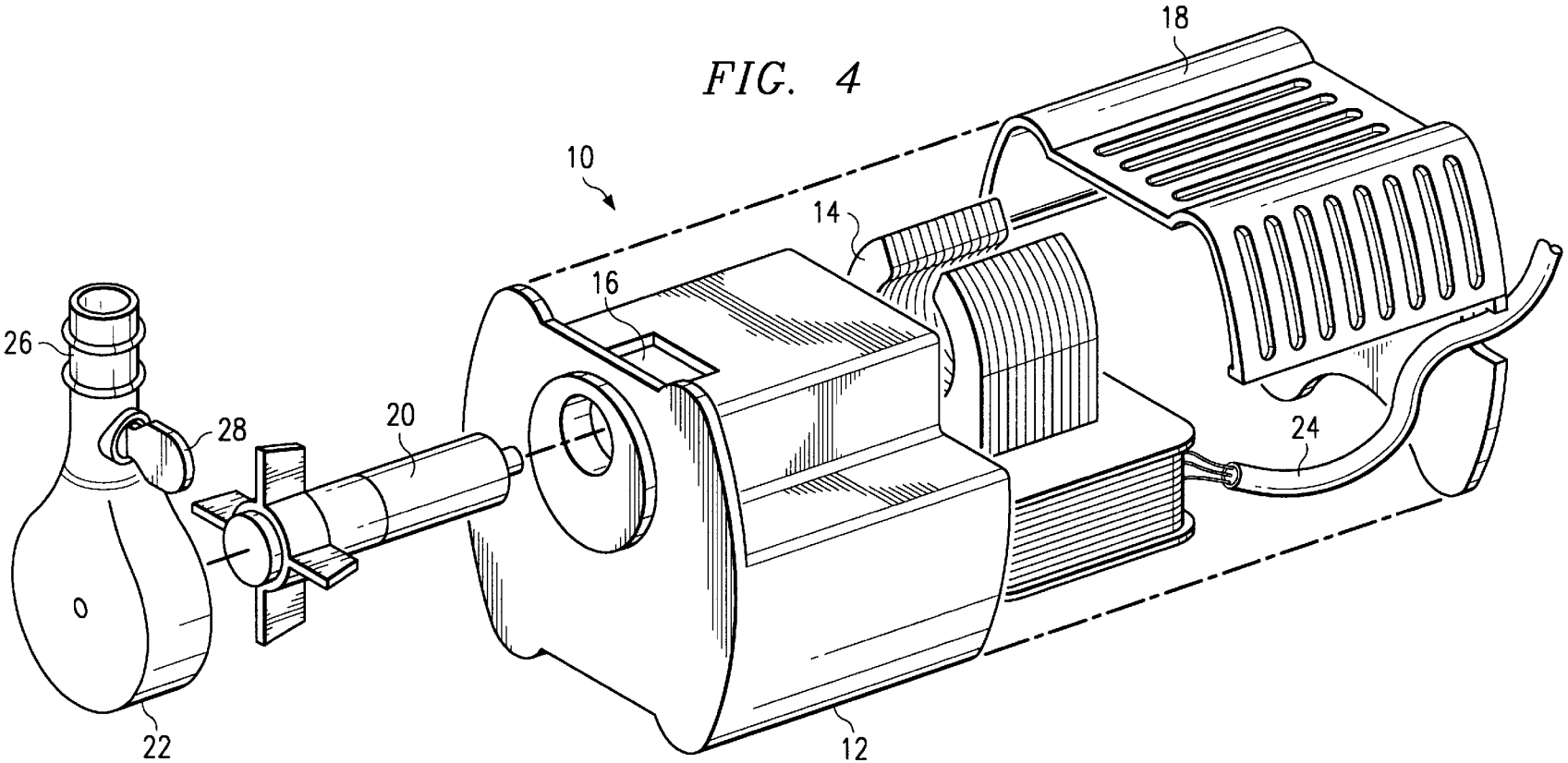
FIG. 4 is an exploded view of the pump illustrating the rotatable volute.

With reference to FIGS. 1, 2 and 4, there is shown a pump 10 which has a housing 12, a stator 14, an intake 16, a backplate screen 18, a rotor/impeller assembly 20 and a rotatable volute 22. A power cord 24 provides electrical energy to the stator to rotate the impeller within the pump.

Pump 10 is illustrated in FIG. 1*a* to be on the bottom of fountain 80.

As can be seen, the volute 22 is capable of being installed in at least two positions relative the housing 12, preferably 180 degrees apart from each other. This permits the pump 10 to be installed with the intake 16 and screen 18 on the bottom of the pump for low water level (shallow) pickup in fountains, as seen in FIGS. 1*a–c* or with the intake 16 and screen 18 on the top for use in dirty waters, such as pond use, as illustrated in FIGS. 2*a*–c. In either event, the volute 22 is preferably positioned relative to the housing so that the discharge 26, typically a ⅝ inch discharge, is oriented upwardly. Clearly, the discharge could be oriented in any manner desired as needed. As shown, the discharge includes a flow control valve 28. Thus, the volute can be rotated 180 degrees, allowing the pump to be positioned with the intake on the bottom for shallow water applications or on the top for dirty water applications. The pump 10 will draw water into intake 16 and pumps it out discharge 26.

Figure 3A:
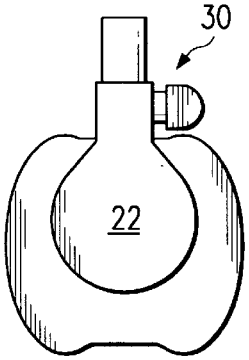
FIGS. 3*a*, 3*b* and 3*c* illustrate front, side and rear views of a pump with a pre-filter with the intake on the top for dirty water.
Figure 3B:
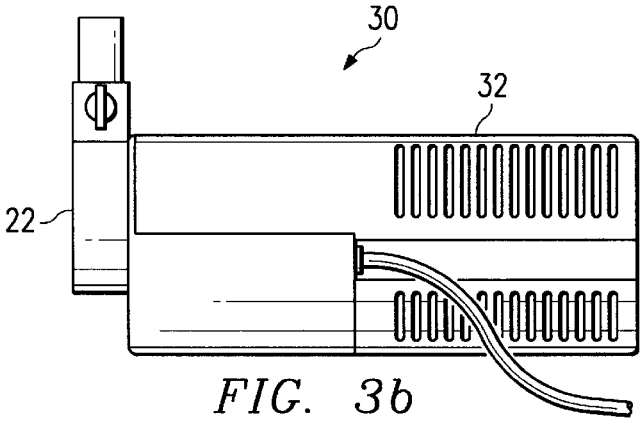
Figure 3C:
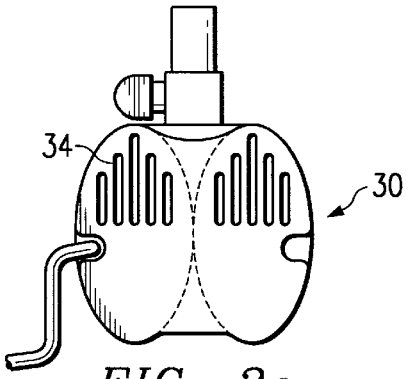
Figure 5:
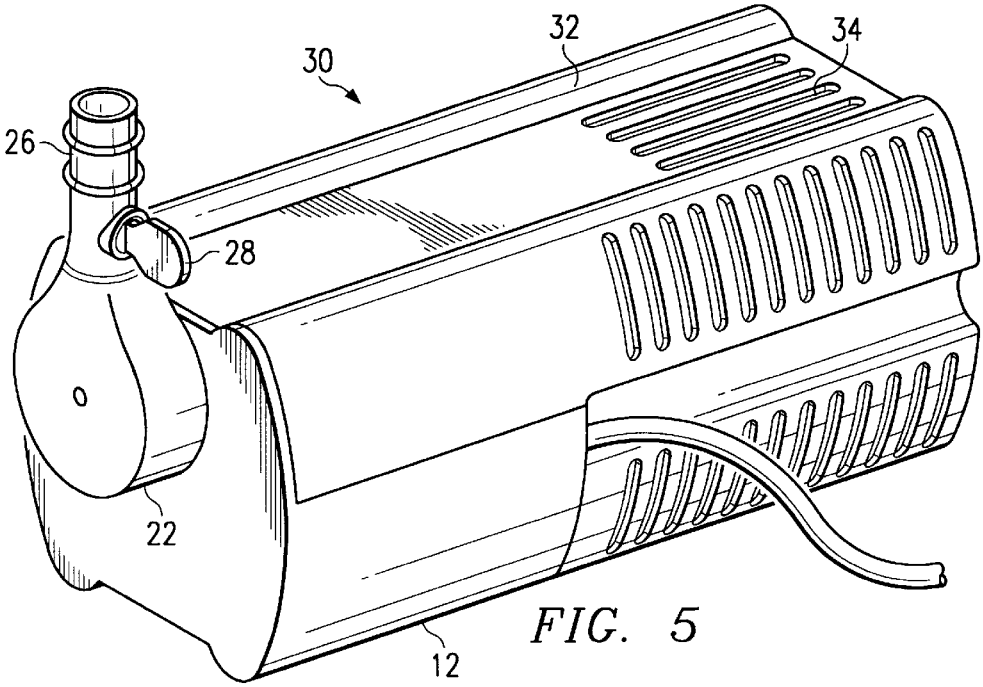
FIG. 5 is a prospective view of the pump with the pre-filter attachment.

With reference to FIGS. 3 and 5, a modified pump 30 is illustrated. Many of the elements of pump 30 are identical to those as pump 10 and are identified by the same reference numerals. Pump 30, however, contains a pre-filter 32 to pre-filter the fluid being pumped. As shown in the figures, this effectively lengthens the length of the pump 30. However, the pump 30 uses the same rotatable volute 22 which allows the inlet 34 of the prefilter 32 and inlet 16 to be positioned at the top, as seen in FIGS. 3*a*–c and 5 for dirty water pickup, such as pond use, or in a configuration with the intake 16 and pre-filter inlet 34 at the bottom for low pickup (not shown) by simply turning the pump 30 upside down from the orientation shown in FIG. 3 and 5 and reversing the position of the volute 22 on the housing 12, just as with pump 10.

Although the present invention has been described with a specific preferred embodiment thereof, various changes and modifications may be suggested to one skilled in the art, and it is intended that the present invention encompass such changes and modifications as fall within the scope of the appended claims.

I claim:

1. A pump for placement within a fountain comprising:

a frame containing an inlet on a first side thereof placed in the fountain;

a volute positionable on the frame in at least two positions, a first position permitting the inlet to be at the bottom of the pump within the fountain and the second position permitting the intake to be at the top of the pump within the fountain.

2. The pump of claim 1 wherein the volute is oriented upward when in the first position or the second position.

3. The pump of claim 1 further comprising an electric power cord extending to the frame within the fountain.

4. The pump of claim 1 further including a pre-filter mounted on the frame.

5. A fountain pump, comprising:

a frame containing an inlet on a first side thereof, a stator mounted within the frame and a rotor/impeller assembly mounted on the frame;

a volute positionable on the frame about the rotor/impeller assembly and positionable on the frame in at least two positions, a first position permitting the inlet on the frame to be at the bottom of the pump for use in tabletop fountains, statuaries, or other clean water shallow applications and the second position permitting the intake to be at the top of the pump for use in garden ponds, fish ponds, or other dirty water applications.

6. The fountain pump of claim 5 wherein the fountain pump is submersible.

7. The fountain pump of claim 5 further having a screen forming the inlet.

8. The fountain pump of claim 5 further comprising a power cord secured to said frame.

9. The fountain pump of claim 5 having a flow control valve on the volute.

10. The fountain pump of claim 5 further comprising a pre-filter.

11. The fountain pump of claim 5 wherein the inlet in the first position permits the fountain pump to operate in ½ inch or less of liquid.

* * * * *